US007603871B2

(12) United States Patent
Kufis

(10) Patent No.: US 7,603,871 B2
(45) Date of Patent: Oct. 20, 2009

(54) HIGH-FLOW COLD AIR CHILLER

(75) Inventor: Andrew C. Kufis, Santa Clara, CA (US)

(73) Assignee: Test Enterprises, Inc., Sunnyvale, CA (US)

( * ) Notice: Subject to any disclaimer, the term of this patent is extended or adjusted under 35 U.S.C. 154(b) by 406 days.

(21) Appl. No.: 11/479,807

(22) Filed: Jun. 29, 2006

(65) Prior Publication Data

US 2008/0000262 A1 Jan. 3, 2008

(51) Int. Cl.
*F25B 7/00* (2006.01)
*F25B 49/00* (2006.01)

(52) U.S. Cl. ..... 62/175; 62/185; 62/198

(58) Field of Classification Search ..... 62/175, 62/185, 198
See application file for complete search history.

(56) References Cited

U.S. PATENT DOCUMENTS 3,852,974 A * 12/1974 Brown ..... 62/79
4,683,726 A * 8/1987 Barron ..... 62/503
5,095,712 A * 3/1992 Narreau ..... 62/113
6,074,573 A * 6/2000 Kaneko ..... 252/68
6,463,744 B1 * 10/2002 Alexeev et al. ..... 62/6
7,111,467 B2 * 9/2006 Apparao et al. ..... 62/79

* cited by examiner

*Primary Examiner*—Marc E Norman
(74) *Attorney, Agent, or Firm*—Law Offices of Thomas E. Schatzel A Prof. Corp.

(57) ABSTRACT

An air-chiller comprises a primary compressor that circulates a mixture of four refrigerants with different boiling points through a primary condenser and several heat-exchanger coils in series. Each heat exchanger coil includes a large section of tubing in which are disposed four smaller sections of tubing. Two of these smaller sections of tubing carry the air to be chilled. The other two smaller sections of tubing carry high pressure refrigerants from the compressor and condenser. The remaining inside volume of the large section of tubing provides for the suction-return of heat-laden refrigerants. Input air passes through the four heat exchangers in series and comes out the fourth one highly refrigerated. The high-pressure refrigerant coming out of the primary compressor is chilled below ambient temperature by a secondary refrigeration sub-system. Such is circulated, after drying, through an auxiliary condenser for additional refrigeration before going to work in the first heat-exchanger coil. The secondary refrigeration sub-system further includes a small compressor that circulates a single HP80 refrigerant through the auxiliary condenser.

8 Claims, 2 Drawing Sheets

HIGH-FLOW COLD AIR CHILLER

BACKGROUND OF THE INVENTION

1. Field of the Invention

The present invention relates to refrigeration systems, and in particular to air chillers for cooling semiconductor devices under-test more efficiently.

2. Description of the Prior Art

One of the consequences of integrating millions of devices into a single microcomputer chip has been the heat generated by so many transistors. The heat represents wasted energy, and a modest amount of heat can shortened the service life of the appliance. Too much heat can destroy the electronics. Wasted energy and excess heating are being addressed on many fronts that include power management and more effective cooling systems. Technology limits are being pushed everywhere.

It used to be enough to heatsink a central processing unit (CPU) integrated circuit (IC) to the metal cabinet or other large metallic mass. Then finned aluminum heatsinks were necessary to be attached directly. Latter, more heat had to be disposed of by attaching small fans directly to the CPU heatsinks.

Still further advances in semiconductor device technology have made chilling them to their lower temperature limits during testing even more challenging. One commercial cooling system that has reached its limits recently is an air-chiller system that uses an exotic mixture of four refrigerants to chill a 10-CFM airflow down to −90° C. The cold airflow is directed onto the CPU heatsinks of high performance microprocessors. A typical test cooling system to do this draws 10-amps.

During testing and characterization, the newest generation of microprocessors needs higher 20-CFM airflows chilled to −90° C. What is needed today is a cooling system for these computers that can produce this doubled-volume of chilled-airflow for testing, but at only modest increases in power demand, e.g., 50% more. Increased chilled air volumes would also allow more devices to be tested in parallel.

A conventional air-chiller for this purpose is described by Dale Missimer in U.S. Pat. No. 3,768,273, issued Oct. 30, 1973, and titled SELF-BALANCING LOW TEMPERATURE REFRIGERATION SYSTEM, and incorporated herein by reference. It uses the familiar compressor, condenser, expansion valve, evaporator, and circulating refrigerants found in conventional air conditioning and refrigeration systems. Four refrigerants with different boiling points are mixed to get a multi-stage effect from the various liquid-vapor phase changes. Such patent describes using a mixture of 21.5 weight-percent (16.0 mol percent) trichlorofluoromethane (R-11), 21.5 weight-percent (18.2 mol percent) dichlorodifluoromethane (R-12), (23.8 wt percent) (23.1 mol percent) chlorotrifluoromethane (R-13), 30.2 weight-percent (35.0 mol percent) carbontetrafluoride (R-14), and, 3.0 weight-percent (7.7. mol percent) argon (R-740). Such fluorocarbons are, of course, no longer permitted in commercial use for refrigeration systems.

Prior art refrigeration systems like this can cool the refrigerants exiting the condenser to no less than the temperature of the ambient air being blown through the condenser. What is needed are better ways to cool down the compressed, liquefied refrigerants before they start their work in chilling the coolant air.

SUMMARY OF THE INVENTION

Briefly, an air-chiller embodiment of the present invention for testing semiconductor devices comprises a primary compressor that circulates a mixture of four refrigerants with different boiling points through a primary condenser and several heat-exchanger coils in series. Each heat exchanger coil includes a large section of tubing in which are disposed four smaller sections of tubing. Two of these smaller sections of tubing carry the air to be chilled. The other two smaller sections of tubing carry high pressure refrigerants from the compressor and condenser. The remaining inside volume of the large section of tubing provides for the suction-return of heat-laden refrigerants. Compressed input air (90-100 psi) passes through the four heat exchangers in series and comes out the fourth one highly refrigerated. Without more, such can produce 10-CFM of air chilled to −90° C. with a power draw of 10-amps. The high-pressure refrigerant coming out of the primary compressor is chilled below ambient temperature by a secondary refrigeration sub-system. Such is circulated, after drying, through an auxiliary condenser for additional refrigeration before going to work in the first heat-exchanger coil. The secondary refrigeration sub-system further includes a small compressor that circulates a single HP80 refrigerant through the auxiliary condenser.

An advantage of the present invention is that a device-test cooling system is provided that can produce larger airflows of chilled air at only modest increases in power levels.

Another advantage of the present invention is a chiller system is provided with reduced levels of suction pressure at the compressor that helps the whole work better and more efficiently.

A further advantage of the present invention is a chiller system is provided that is more energy efficient than prior art systems.

A still further advantage of the present invention is a chiller system is provided that enables the newer generation of microprocessor and FPGA devices to be properly cooled during test.

These and other objects and advantages of the present invention will no doubt become obvious to those of ordinary skill in the art after having read the following detailed description of the preferred embodiments which are illustrated in the various drawing figures.

IN THE DRAWINGS

DETAILED DESCRIPTION OF THE PREFERRED EMBODIMENT

Figures 1, 2:
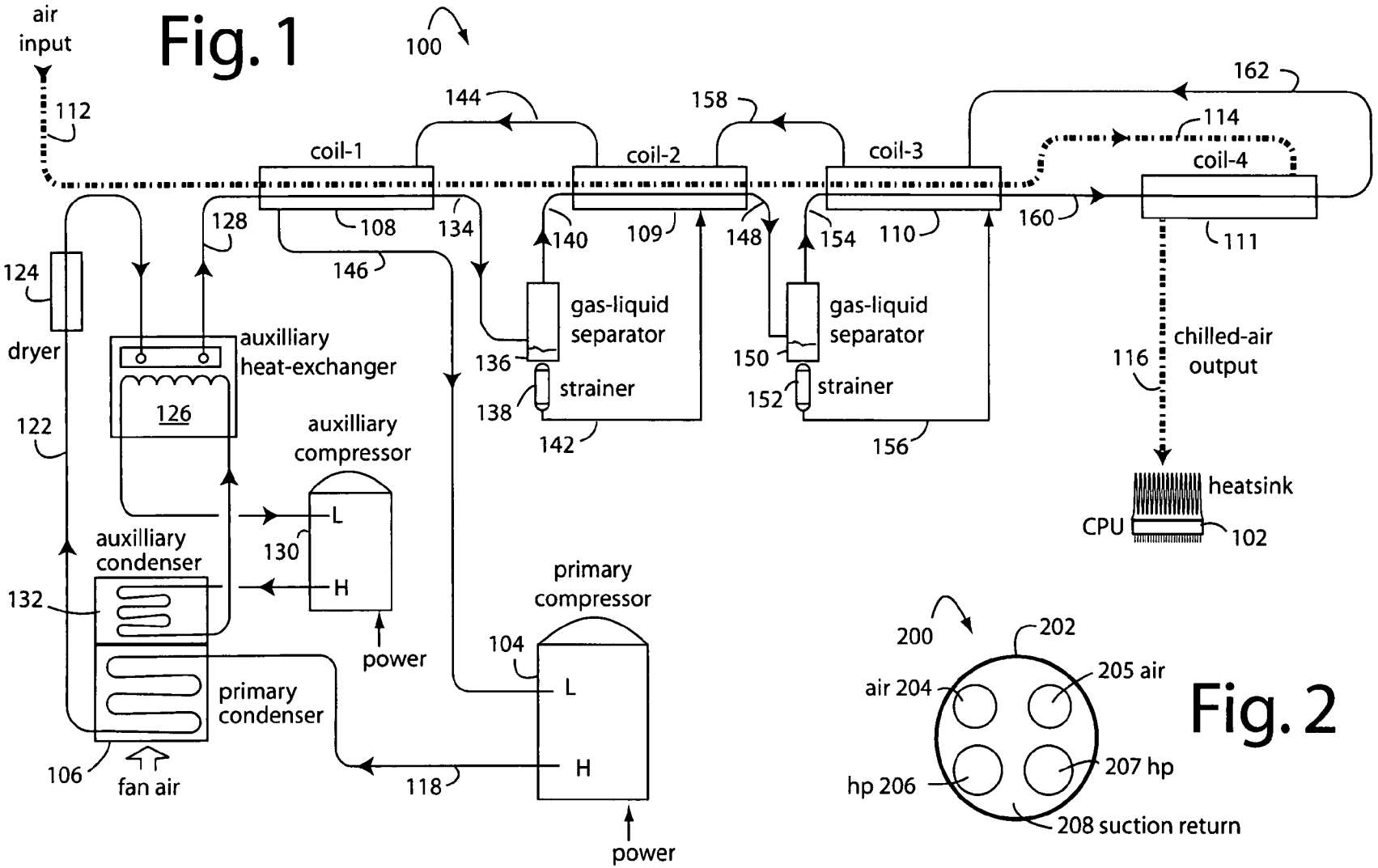
FIG. 1 is a schematic diagram of an air-chiller system embodiment of the present invention, and shows one application of it for cooling a high performance microprocessor device.
FIG. 2 is a cross-sectional diagram of a heat-exchanger coil as used in the system of FIG. 1.

FIG. 1 represents a device-test air-chiller system embodiment of the present invention, and is referred to herein by the general reference numeral 100. The air-chiller system 100 provides for cooling during device characterization and testing, e.g., of an advanced microprocessor (CPU) 102 with a heatsink. Other applications include field programmable gate arrays (FPGA) and other modern semiconductors.

The device-test air-chiller system 100 includes a primary compressor 104 for circulating a mixture of refrigerants with different boiling points through a primary condenser 106 and several heat-exchanger coils (coil-1 to coil-4) 108-111 in series. For example, the four refrigerants used are R14, R23, R123, and R124.

An input air 112 to-be-chilled is compressed to about 90-100 psi. It is passed, in series, through internal tubing inside the first three heat-exchangers, exiting as airflow 114. The compressed air then enters the jacket of heat-exchanger coil 111 and comes out as a highly refrigerated chilled-air output 116. This is then able to effectively cool a device like CPU 102. A typical output 116 will produce 20-CFM of air chilled to −90° C.

A high pressure (HP) refrigerant flow 118 from primary compressor 104 is directed to the primary condenser 106. A fan blows air through the primary condenser 106 and cools the refrigerants so they give up the heat they collected and phase change from gas to liquid. An HP liquid flow 122 passes through a dryer 124 to remove any water vapor. Ideally, such HP liquid flow 122 will have been cooled down to the ambient temperature of the fan air, but of course it could not be any cooler than that.

An auxiliary heat exchanger 126 chills the HP liquid flow 122 down, e.g., to −22° C. in a flow 128. It does this with an auxiliary refrigeration sub-system comprising an auxiliary compressor 130, and an auxiliary condenser 132. Such circulates a single refrigerant, e.g., HP80, through the auxiliary heat-exchanger 126, condenser 132, and compressor 130.

The input air 112 gives up its heat to flow 128 first in coil-1 108. The liquefied flow 128 will absorb a lot of heat if its constituents phase change from liquid to gas. Since there are four constituent refrigerants, this can occur at least four times at four different temperatures. The heat pickup causes an output flow 134 to generate gases that are separated out by a separator 136 and strainer 138. Those constituents that are gas are sent onward in a flow 140. Those constituents that are still liquid are expanded into a gas in a flow 142. The expansion occurs in the jacket of coil-2 109, and absorbs a large amount of heat from compressed air flow before returning in a flow 144 to coil-1 108 and a suction return flow 146 to primary compressor 104.

The compressed air from input air 112 gives up more heat to flows 140, 142 in coil-2 109. The heat pickup in flow 140 causes an output flow 148 to generate gases that are separated out by a separator 150 and strainer 152. The gas constituents continue on in a flow 154, and the liquid constituents are expanded in a flow 156. The expansion occurs in the jacket of coil-3 110, and absorbs a large amount of heat from compressed air flow before returning in a flow 158 to coil-2 109 and eventually to the suction return flow 146 and primary compressor 104.

The last stage for the air from input air 112 to give up its heat occurs in coil-4 111. The air exits coil-3 110 as a chilled compressed airflow 114, and enters the jacket of coil-4 111. The heat pickup in flow 160 causes an output flow 162 to phase change to gas if it is going to. The chilled-air output 116 is then useful for cooling CPU 102, or any other semiconductor device under test. All the remaining refrigerant constituents are returned back in flow 162, eventually making it back to suction return flow 146 and primary compressor 104.

In the primary system, the exact mixture and ratios of the refrigerants best used requires some experimentation to find the optimal mix. At present, the preferred mix comprises R14 (CF) tetraflurometh ane; R23 (CHF) trifluromethane; R123 (CHCI CF), 2,2-dichloro-1,1,1-trifluoroethane; and, R124 (CHCIFCF), 1-chloro-1,2,2,2-tetrafluoroethane. Two of these are gases, and two are liquids. They are balanced in the system 100 according to several observations, e.g., the suction pressure at the primary compressor 104 should not be too high or too low, e.g., 10 psi is good. The compressor current should be minimized. The output airflow temperature should be minimized. The refrigerant temperatures at the outputs of the condensers should be lowered as much as possible to the ambient air temperature. Too high an output pressure at the compressor is undesirable, among other things, it can mean there is too much refrigerant in the system.

Referring to FIG. 2, a typical heat-exchanger coil 200 includes a large section of insulated tubing 202 in which are disposed four smaller sections of tubing 204-207. Two of these smaller sections of tubing 204-205 carry the air to be chilled. The other two smaller sections of tubing 206-207 carry the high pressure refrigerant mix from the compressor and condenser. The remaining inside volume 208 of the large section of tubing provides for the suction-return of heat-laden refrigerants that have principally phase changed into gases.

Tests were run of a prototype of system 100 in comparison with a similar, but conventional system. The results are summarized in Table-I.

TABLE I

| Standard Chiller v. Improved Design | | |
|---|---|---|
| Flow Rate (SCFM) | Standard Air Chiller, Output Temp (° C.) | Air Chiller with Auxiliary Condenser, Output Temp (° C.) |
| using 60-Hz Power | | |
| 6 | −105 | −99 |
| 8 | −98 | −98 |
| 10 | −84 | −98 |
| 12 | −76 | −96 |
| 14 | −71 | −96 |
| 16 | −64 | −95 |
| 18 | −60 | −95 |
| 20 | −57 | −93 |
| using 50-Hz Power | | |
| 6 | −97 | −96 |
| 8 | −86 | −95 |
| 10 | −74 | −94 |
| 12 | −67 | −93 |
| 14 | −62 | −92 |
| 16 | −57 | −91 |
| 18 | −53 | −90 |
| 20 | −51 | −88 |

Refrigerants used:

R123, 10 oz; R-124, 12 oz; R23, 70 psi; R14, 130 psi

Figure 3:
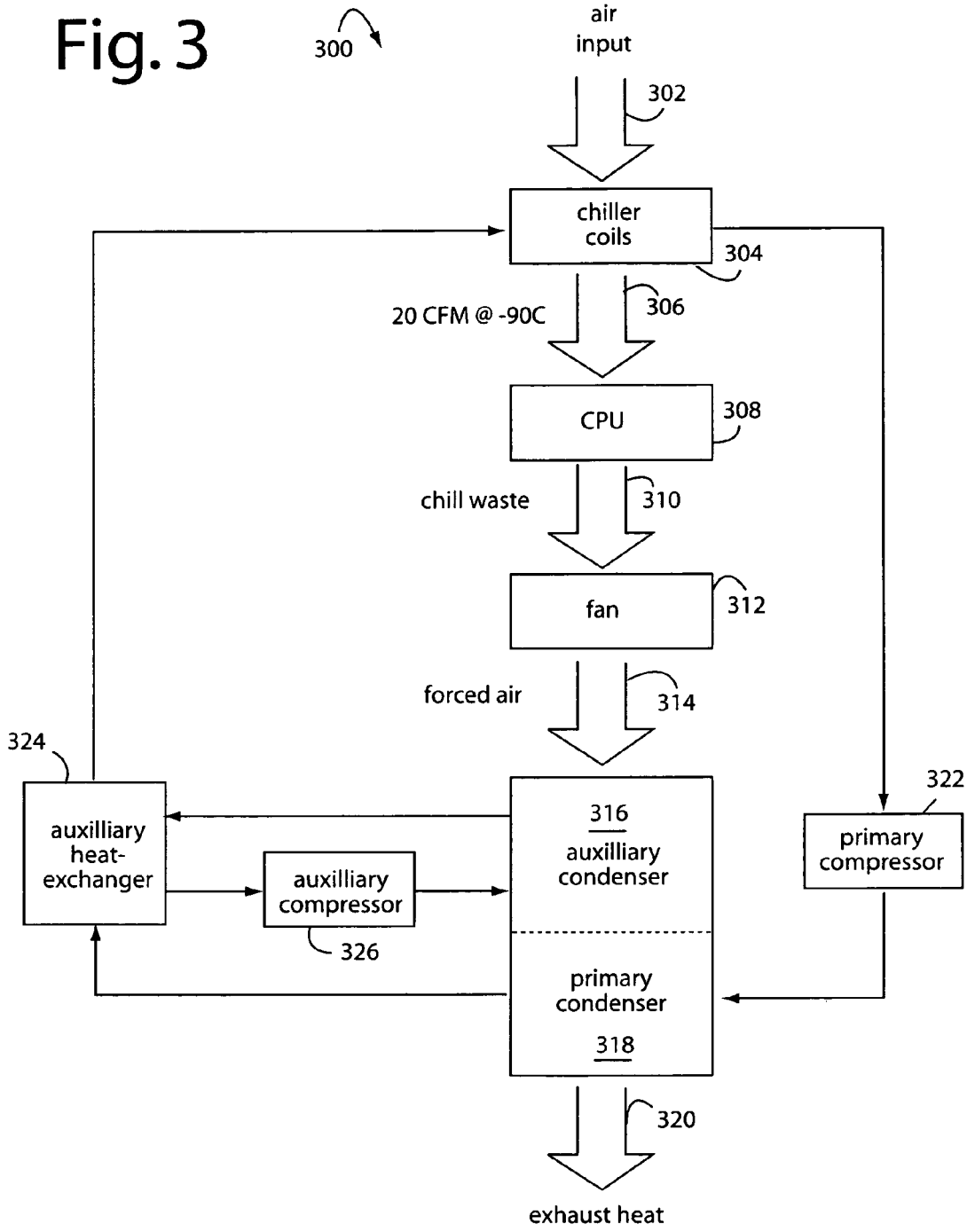
FIG. 3 is a functional block diagram of an air re-use chiller system embodiment of the present invention similar to that of FIG. 1 but including a chill waste airflow to help cool the condensers better than ambient temperature airflow.

FIG. 3 represents an air re-use cooling system 300, similar to that of FIG. 1, but with a cooling recovery. Referring to FIG. 1, the chilled-air output 116 once applied to do its job in cooling CPU 116 may still be cool enough to do useful work. One way to recover any cooling that would otherwise be wasted is in diagrammed in FIG. 3.

The recirculating cooling system 300 takes an input air 302 through a series of chiller coils 304 to produce a chilled airflow 306. This will, e.g., give 20-CFM of air chilled to −90° C. A CPU 308 is cooled by this flow and a chill waste airflow 310 is recovered. This is blown by a fan 312 into a forced-air flow 314 through an auxiliary condenser 316 and a primary condenser 318. An exhaust heat airflow 320 is disposed of. A primary compressor 322 compresses return gases from the chiller coils 304 for condensation and heat expulsion by primary condenser 318. Further heat is removed from the high pressure flow by an auxiliary heat-exchanger 324. An auxiliary compressor 326 circulates a separate refrigerant flow through the auxiliary condenser 316.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

The invention claimed is:

1. A method for providing increased chilled airflows for the cooling of a semiconductor device under test, while maintaining or improving the air-coolant exhaust temperatures, comprising:

cooling an auxiliary condenser by a secondary single stage refrigeration system that contains a condenser that shares the cooling fan of the primary condenser for the mixed refrigerant refrigeration system;

pre-chilling a high pressure flow of a mixture of refrigerants exiting a primary condenser from above an ambient air temperature to a temperature substantially below said ambient air temperature; and then using said refrigerated high pressure flow of said mixture of refrigerants to chill an input air in a series of heat-exchanger coils.

2. The method of claim 1, wherein the step of refrigerating further comprises:

configuring an auxiliary condenser to share fan air with said primary condenser;

circulating a single refrigerant through said auxiliary condenser with an auxiliary compressor.

3. The method of claim 1, further comprises:

recovering a chill waste and recirculating it through said primary condenser to improve otherwise over using ambient temperature air.

4. An air-chiller system, comprising:

an open airflow circuit having a compressed air input and a chilled-air output;

a primary mixed-refrigerant circuit of a plurality of refrigerants with different boiling points;

a primary compressor and a primary condensor included in the primary mixed-refrigerant circuit;

a series of heat exchangers through which the open airflow circuit passes through from a first to a last heat exchanger, and through which the mixed-refrigerant circuit passes through from said first to said last heat exchanger, and then returns from said last to said first heat exchanger, wherein heat is removed from the open airflow circuit, and wherein each constituent refrigerant material operates with a corresponding single heat exchanger; and an auxiliary refrigerant circuit that includes an auxiliary heat-exchanger, an auxiliary compressor and an auxiliary condenser, and connected to provide chilling only to the refrigerants in the primary mixed-refrigerant circuit;

wherein, the primary mixed-refrigerant circuit passes through the primary condenser, and then is pre-chilled by the auxiliary heat-exchanger to below the ambient temperature of the primary condenser, at a point just before entering the series of heat exchangers that chill the open airflow circuit.

5. The air-chiller system of claim 4, wherein the mixed-refrigerant circuit includes a mixture of refrigerants with different boiling points in an empirically derived balance of R14 (CF) tetrafluromethane; R23 (CHF) trifluromethane; R123 (CHCI CF), 2,2-dichloro-1, 1,1-trifluoroethane; and, R124 (CHCIFCF), 1-chloro-1,2,2,2-tetrafluoroethane.

6. The air-chiller system of claim 4, wherein the auxiliary condenser shares fan air with the primary condenser.

7. An improved method of air-chilling, comprising:

a primary refrigeration system with a high pressure flow of mixed-refrigerants that leave a primary condenser at temperatures above ambient;

characterized by:

devoting an auxiliary refrigeration system solely to the pre-chilling said high pressure flow of mixed-refrigerants leaving said compressor to a lower than said ambient temperatures before passing them to a plurality of heat exchangers in series used only in the cooling of a compressed air flow; and including constituent refrigerant materials in said mixed-refrigerants each with different physical characteristics that selectively operate with a corresponding single heat exchanger in said plurality of heat exchangers in series;

wherein, air flow volumes and chilling through said heat exchangers are improved.

8. The method of claim 7, wherein improvements to said air flow volumes and chilling through said series of heat exchangers of the primary refrigeration system are better than 20-CFM and −90° C.

* * * * *